United States Patent [19]

Higgins

[11] Patent Number: 4,522,857

[45] Date of Patent: Jun. 11, 1985

[54] CARPET TILE WITH STABILIZING MATERIAL EMBEDDED IN ADHESIVE LAYER

[75] Inventor: Kenneth B. Higgins, LaGrange, Ga.

[73] Assignee: Milliken Research Corporation, Spartanburg, S.C.

[21] Appl. No.: 653,281

[22] Filed: Sep. 24, 1984

[51] Int. Cl.[3] ..... D03D 27/00; D04H 11/00; D05C 17/00

[52] U.S. Cl. ..... 428/95; 428/82; 428/97

[58] Field of Search ..... 428/95, 82, 97

[56] References Cited

U.S. PATENT DOCUMENTS 4,010,302 3/1977 Anderson et al. ..... 428/95

4,286,003 8/1981 Higgins et al. ..... 428/95

*Primary Examiner*—Marion E. McCamish

*Attorney, Agent, or Firm*—Earle R. Marden; H. William Petry

[57] ABSTRACT

A freelay tufted or bonded carpet tile which has a carpet base of foam thereon to increase the comfort level and decrease fatigue to the person or persons walking thereon and also lowers the noise level due to a decrease in accoustical value.

8 Claims, 2 Drawing Figures

CARPET TILE WITH STABILIZING MATERIAL EMBEDDED IN ADHESIVE LAYER

This invention relates to freelay carpet tiles having a tufted or bonded carpet surface which provide improved comfort to the parties walking thereon. The improved carpet tile is preferably employed in commercial installations where comfort and reduced acoustical value is a necessity due to the long hours of constant use but, obviously, comfort is also a factor in the use of residential carpet.

Therefore, it is an object of the invention to provide a carpet tile which increases the comfort level and decreases fatigue on the person or persons walking on the installed carpet tile.

Figure 1:
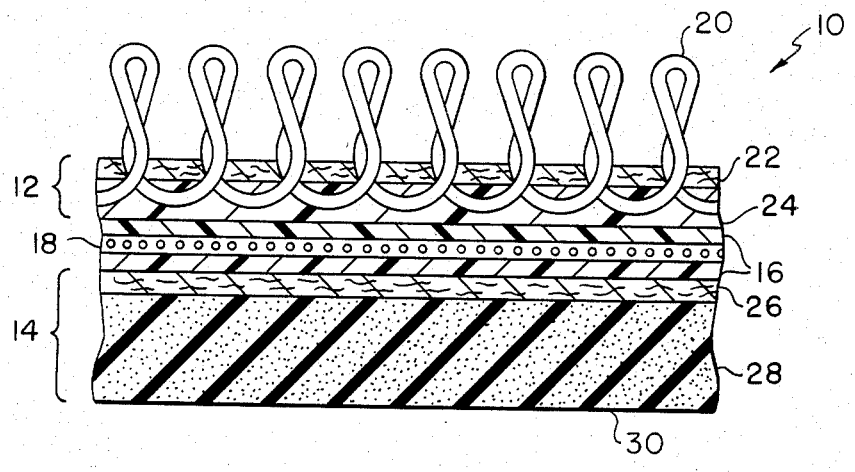
Figure 2:
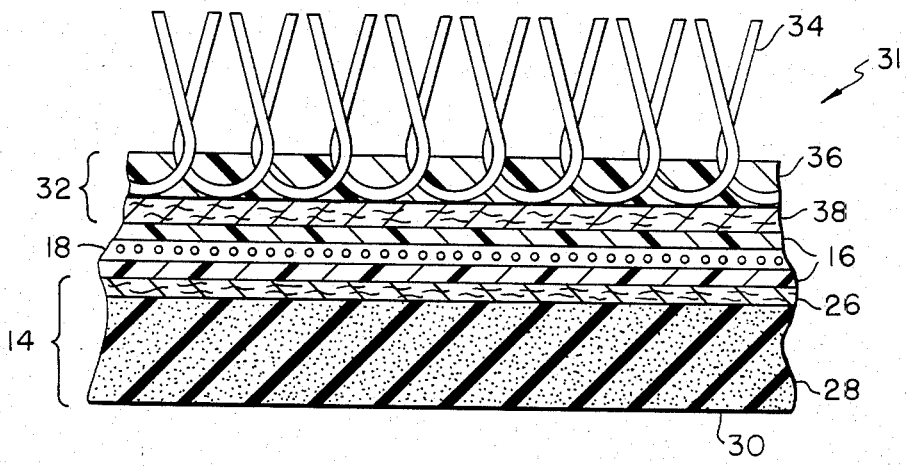

Other objects and advantages of the invention will become readily apparent as the specification proceeds to describe the invention with reference to the accompanying drawing, in which:

FIG. 1 is a cross-sectional view taken through the new and improved freelay tufted tile; and FIG. 2 is a view similar to FIG. 1 except it is a cross-sectional view taken through a bonded freelay carpet tile.

Looking now to FIG. 1, a new and tufted carpet tile 10 is depicted. The carpet tile 10 basically consists of the primary carpet base 12 and the foam layer 14. The primary carpet base 12 is laminated to the foam lay 14 by an adhesive layer 16 in which is embedded a layer of glass scrim 18 to provide dimensional stability to the tile 10 when the adhesive layer 16 has been solidified to provide a unitary structure.

The carpet base layer 12 consists of a loop pile layer 20 of a thickness in the range of $\frac{1}{8}$"–1" created by tufting nylon continuous fibers into a primary backing 22 of woven polyester. To bond the tufts of nylon in position on the backing 22, a precoat of latex 24 is applied.

As described above, the loop pile layer 20 is preferably nylon but other suitable synthetic yarns such as polyester, polypropylene, acrylic or blends thereof can be employed. The backing layer 22 is preferably woven but could be non-woven and/or of other synthetic material such as nylon, fiberglass or polypropylene. The latex layer 24 is preferably styrene butadiene but other suitable materials such as urethane, PVC, acrylic, etc., could be employed.

The adhesive layer 16 is a layer with a thickness in the range of 0.010"–0.070" of polyolefin, modified polyolefin, polyamide or other suitable thermoplastic material with a weight in the range of 10–70 oz./sq. with the preferred weight being about 50 oz./sq. yard. The embedded stabilizing material is glass scrim but could be a woven or non-woven material of glass or other suitable material such as polyester, nylon or polypropylene.

The foam layer 14 is approximately 5/32" in thickness and consists of a 0.020" fibrous carrier backing 26 of woven polypropylene coated with a high density urethane foam 28 having a tough integral skin surface 30 on the underside thereof.

The carrier backing 26 can be woven or non-woven and composed of other materials such as nylon, polyester or fiberglass. The thickness of this layer can vary in the range of 0.01"–0.04".

The foam layer 28 can vary in thickness from 0.1" to 1.0" and is preferably a high density urethane but suitable equivalents such as styrene butadiene latex or PVC can be used, if desired. The applied foam can vary from about 10 oz./sq. yd. to about 60 oz./sq. yd. but preferably is about 38 oz./sq. yd.

FIG. 2 shows another embodiment of carpet tile 31 employing the same type foam layer base 14 and same laminating layers 16 and 18 but having a different type primary carpet base 32. The carpet base 32 basically consists of cut pile yarns 34 of nylon or other suitable material implanted in a PVC or hot melt adhesive 36 which is laminated to a reinforcement or substrate layer of a woven or non-woven material 38 of fiberglass, nylon, polypropylene or polyester.

It can be seen that the above described carpet tile provides a tile which has a cushioned backing which has dimensional stability as well as construction that enhances the comfort level and decreases the fatigue to a person or persons who spend a great deal of time on their feet on a carpeted area and decreases effect of noise by decreasing the acoustical value. This is especially true in commercial establishments where people spend a considerable amount of time each day.

Although the preferred embodiments of the invention have been described, it is contemplated that many changes may be made without departing from the scope or spirit of the invention and it is desired that the invention be limited only by the scope of the claims.

I claim:

1. A carpet tile comprising: a primary carpet base having pile yarns projecting upwardly therefrom, a foam base layer below said primary carpet base and a thermoplastic material securing said primary carpet base to said foam layer base and having a layer of stabilizing material embedded therein, said foam layer base having a carrier material adjacent said thermoplastic material and a high density foam material on the side of said carrier material away from said carrier material.

2. A carpet tile of claim 1 wherein said pile yarns are pile yarns tufted into a substrate material.

3. The carpet tile of claim 1 wherein said pile yarns are pile yarns bonded to a substrate material.

4. The carpet tile of claim 1 wherein said foam material is a high density urethane.

5. The carpet tile of claim 4 wherein said foam material has a weight in the range of 10–60 oz./square yard.

6. The carpet tile of claim 5 wherein said foam material has a weight of approximately 38 oz./square yard.

7. A carpet tile comprising: A primary carpet base having pile yarn projecting upwardly therefrom, a foam base layer below said primary carpet base and an adhesive material between and laminating said primary carpet and said foam base layer together, said adhesive material having a glass fabric embedded therein to provide dimensional stability to said carpet tile, said foam base layer having a first layer of high density urethane and a polypropylene carrier fabric laminated thereto, said urethane having a weight in the range of 10–60 ozs./square yard.

8. The carpet tile of claim 7 wherein the bottom of said urethane has a tough integral skin surface on the bottom thereof.

* * * * *